US005933508A

United States Patent [19]

Fuke et al.

[11] Patent Number: 5,933,508

[45] **Date of Patent: *Aug. 3, 1999**

[54] HORN SPEAKER SYSTEM

[75] Inventors: Nobuo Fuke, Chiba; Katsuya Endo; Yoshiteru Kamatani, both of Kanagawa, all of Japan

[73] Assignee: Sony Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/965,240

[22] Filed: Nov. 6, 1997

Related U.S. Application Data

[63] Continuation of application No. 08/309,896, Sep. 20, 1994.

[30] Foreign Application Priority Data

Sep. 22, 1993 [JP] Japan ..... 5-236851
Sep. 28, 1993 [JP] Japan ..... 5-241739

[51] Int. Cl.[6] ..... H04R 25/00

[52] U.S. Cl. ..... 381/343; 381/398; 381/407; 381/430

[58] Field of Search ..... 381/156, 193, 381/195, 205, 202, 189, 339, 340, 341, 342, 343, 398, 407, 412, 423, 426, 427, 430, FOR 143; 181/157, 159, 166, 167, 168, 171

[56] References Cited

U.S. PATENT DOCUMENTS

| | | | |
|---|---|---|---|
| 2,164,374 | 7/1939 | Barker . | |
| 3,665,124 | 5/1972 | Sotome | 381/195 |
| 3,905,448 | 9/1975 | Kawakami et al. | 181/172 |
| 3,991,286 | 11/1976 | Henricksen | 381/189 |
| 4,525,604 | 6/1985 | Frye . | |
| 5,148,492 | 9/1992 | Uzawa et al. | 381/193 |

FOREIGN PATENT DOCUMENTS

| | | | |
|---|---|---|---|
| 0 235 991 | 9/1987 | European Pat. Off. . | |
| 0 457 474 | 11/1991 | European Pat. Off. . | |
| 62-8078 | 3/1980 | Japan . | |
| 0047998 | 2/1990 | Japan | 381/202 |

*Primary Examiner*—Huyen Le
*Attorney, Agent, or Firm*—Hill & Simpson

[57] ABSTRACT

A horn speaker system includes a dome-shaped diaphragm, a coil bobbin, a phase equalizer, and a magnetic circuit. The coil bobbin is integral with the dome-shaped diaphragm, and a voice coil is wound on the coil bobbin near a free end thereof. The magnetic circuit coacts with the voice coil for producing forces to actuate the dome-shaped diaphragm. The magnetic circuit includes a cylindrical magnet, a first annular yoke attracted to one end of the cylindrical magnet and having a central opening, a plate cooperating with the first yoke in defining a gap in which the coil bobbin is inserted, and a second yoke attracted to an opposite end of the magnet. The magnet, the first yoke, the first plate, and the second yoke jointly make up a closed magnetic circuit. The phase equalizer serves to keep sounds outputted from the dome-shaped diaphragm in phase. The phase equalizer is mounted on the first yoke and has a plurality of slits defined therein. The magnet, the first yoke, the phase equalizer, and the dome-shaped diaphragm are stacked coaxially with each other.

4 Claims, 12 Drawing Sheets

ACOUSTIC IMPEDANCE (Ns/m5)

(Ns/m5)
1K
10K
100K (Ns/m5)
1K
10K
100K (Ns/m5)
1K
10K
100K (Ns/m5)
1K
10K
100K
FREQUENCY (Hz)

ACOUSTIC IMPEDANCE (Ns/m5)
(Ns/m5)

1K
10K
100K
(Ns/m5)

1K
10K
100K (Ns/m5)
1K
10K
100K (Ns/m5)
1K
10K
100K
FREQUENCY (Hz)

HORN SPEAKER SYSTEM

This is a continuation of application Ser. No. 08/309,896, filed Sep. 20, 1994.

BACKGROUND OF THE INVENTION

The present invention relates to a horn speaker system, and more particularly to a horn speaker system having a dome-shaped diaphragm.

Horn speaker systems primarily for reproducing sounds in a high-frequency range have a dome-shaped diaphragm. The sounds produced by the a dome-shaped diaphragm are collected by a phase equalizer and then introduced into a horn, from which the sounds are radiated into an exterior space.

The horn speaker system is unable to achieve designed frequency characteristics unless the magnetic circuit for actuating the diaphragm is positioned accurately with respect to the diaphragm. Therefore, the components of the magnetic circuit, including a magnet, are assembled precisely with jigs. In particular, it has been customary to define a gap in which a voice coil is to be disposed, precisely with a jig called "gap gage" because the width of the gap is very small. However, it has been tedious and time-consuming to produce such a gap precisely with the gap gage.

Some of the components of the magnetic circuit, e.g., the magnet, are difficult to fasten with screws due to their structural limitations. Those components are usually fixed in place by an adhesive. One problem with the use of adhesive is that the adhesive applied to bond the components tends to block the flow of magnetic fluxes in the magnetic circuit, resulting in a reduction in the magnetic efficiency and hence a degradation of the speaker characteristics.

It is important that the diaphragm of a horn speaker system be reduced in weight for improved speaker performance, e.g., the quality of reproduced sounds, the energy conversion efficiency, etc. It is also desired that the horn speaker systems be capable of reproducing sounds with as flat a frequency characteristic curve in a wide frequency range.

One form of diaphragm for use in a horn speaker system is integrally formed with an edge and comprises a metal sheet. In order to maintain a degree of durability and rigidity required by the edge, the thickness of the metal sheet is greater than that of a diaphragm which is separate from an edge. Therefore, the metal sheet is relatively heavy, with the result that the horn speaker system has poor frequency characteristics and response characteristics.

Phase equalizers for use in horn speaker systems can keep accurate phase matching unless properly shaped. In the absence of accurate phase matching, sounds reproduced by the horn speaker system may be unclear or may not have a flat frequency characteristic curve. It has been tedious and time-consuming to design a phase equalizer for desired good frequency characteristics.

SUMMARY OF THE INVENTION

It is, therefore, an object of the present invention to provide a horn speaker system which will solve the above-mentioned problems.

According to the present invention, there is provided a horn speaker system which includes a dome-shaped diaphragm, a coil bobbin, a voice coil, an edge, and a magnetic circuit. The coil bobbin is integral with the dome-shaped diaphragm, and the a voice coil is wound around the coil bobbin. The edge is attached to the dome-shaped diaphragm. The magnetic circuit coacts with the voice coil for producing forces to actuate the dome-shaped diaphragm. The dome-shaped diaphragm is made of a material having a thickness which is at most 70% of a thickness equivalent in mechanical strength to a thickness of a material of the edge.

According to the present invention, there is also provided a horn speaker system which includes a dome-shaped diaphragm, a coil bobbin, a voice coil, a magnetic circuit, and a phase equalizer. The coil bobbin is integral with the dome-shaped diaphragm, and the voice coil is wound around the coil bobbin. The magnetic circuit coacts with the voice coil for producing forces to actuate the dome-shaped diaphragm. The magnetic circuit includes a cylindrical magnet, a first yoke attracted to one end of the cylindrical magnet and having a central opening, the first yoke defining a gap in which the coil bobbin is inserted. The phase equalizer serves to keep sounds outputted from the dome-shaped diaphragm in phase. The phase equalizer is positioned on one side of the dome-shaped diaphragm, the phase equalizer being mounted on the first yoke. The cylindrical magnet, the first yoke, the phase equalizer, and the dome-shaped diaphragm are stacked coaxially with each other.

According to the present invention, there is further provided a horn speaker system which includes a dome-shaped diaphragm, a coil bobbin, a magnetic circuit, and a phase equalizer. The coil bobbin is integral with the dome-shaped diaphragm, and the voice coil is wound around the coil bobbin. The coil bobbin having a portion on which the voice coil is wound and which is inserted in the magnetic circuit, and the magnetic circuit coacts with the voice coil for producing forces to actuate the dome-shaped diaphragm. The phase equalizer serves to keep sounds outputted from the dome-shaped diaphragm in phase. The phase equalizer is positioned on one side of the dome-shaped diaphragm. The phase equalizer has a partly spherical surface facing the dome-shaped diaphragm and a plurality of concentric slits defined therethrough and extending from the partly spherical surface toward a surface thereof opposite to the partly spherical surface. At least one of the slits has a cross-sectional area across a partly spherical surface concentric with the partly spherical surface facing the dome-shaped diaphragm. The cross-sectional area progressively increases in a direction from the partly spherical surface facing the dome-shaped diaphragm toward the surface opposite to the partly spherical surface.

As described above, the dome-shaped diaphragm is made of a material having a thickness which is at most 70% of a thickness equivalent in mechanical strength to a thickness of a material of the edge. The dome-shaped diaphragm and the edge may be made of optimum materials and have suitable thicknesses selected such that the overall weight of a movable assembly composed of the diaphragm and the edge may be reduced.

The components of the magnetic circuit can easily be assembled by being attracted under magnetic forces of the magnet and fitted with each other. As no adhesive is used to join the components of the magnetic circuit, the flow of magnetic fluxes in the magnetic circuit is not blocked.

The cross-sectional areas of the slits across a partly spherical surface concentric with the partly spherical surface facing the dome-shaped diaphragm progressively increase in the direction from the partly spherical surface facing the dome-shaped diaphragm toward the surface opposite to the partly spherical surface. Therefore, resonance of the acoustic impedances of the slits are suppressed. The phase equalizer with these slits does not make the reproduced sounds indistinct for thereby allowing the horn speaker system to reproduce clear sounds with good characteristics.

DETAILED DESCRIPTION OF THE PREFERRED EMBODIMENTS

A horn speaker system according to an embodiment of the present invention is designed to reproduce sounds in a frequency range higher than 500 Hz, for example.

Figure 1:
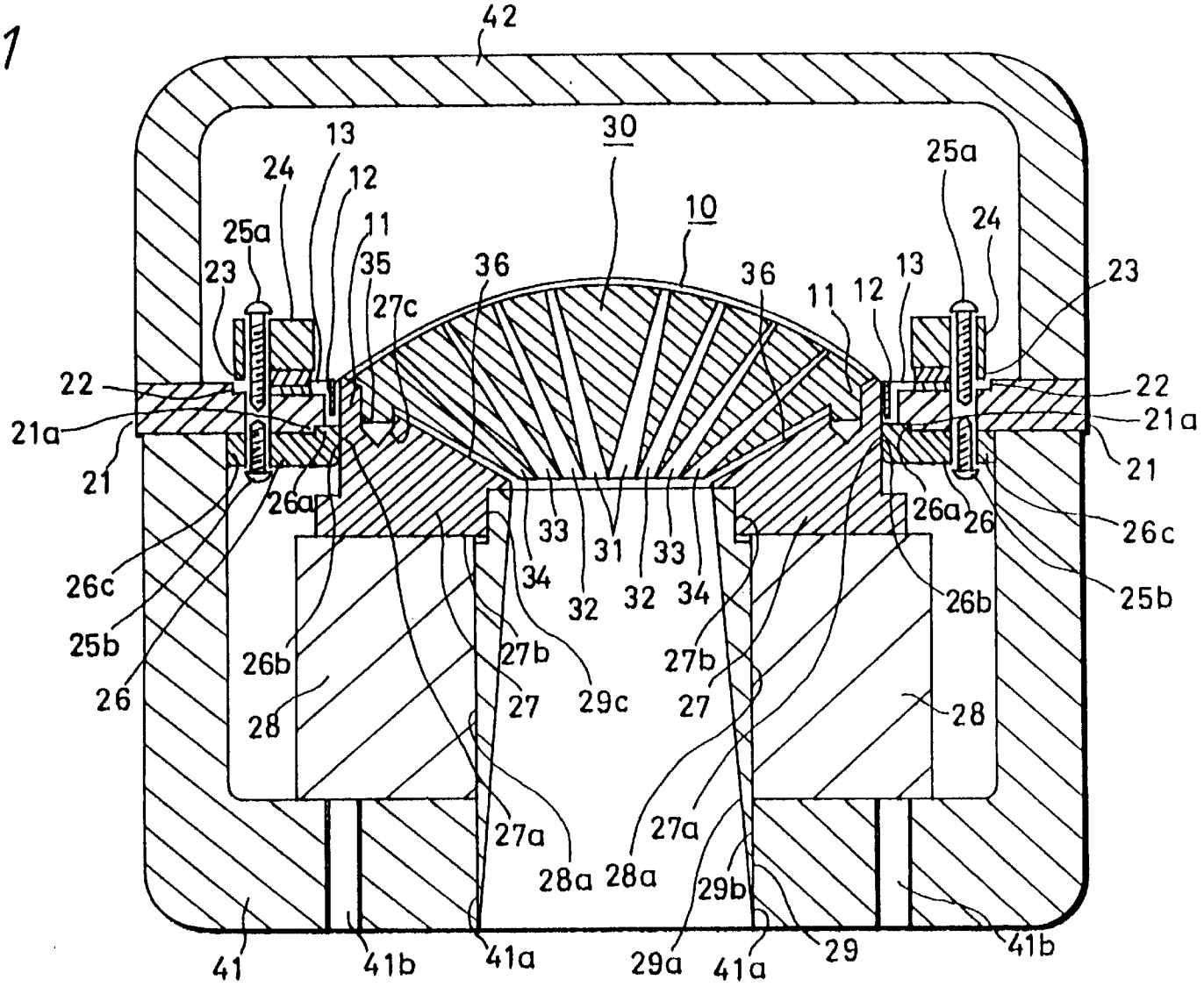
FIG. 1 is a cross-sectional view of a horn speaker system according to an embodiment of the present invention.
Figure 2:
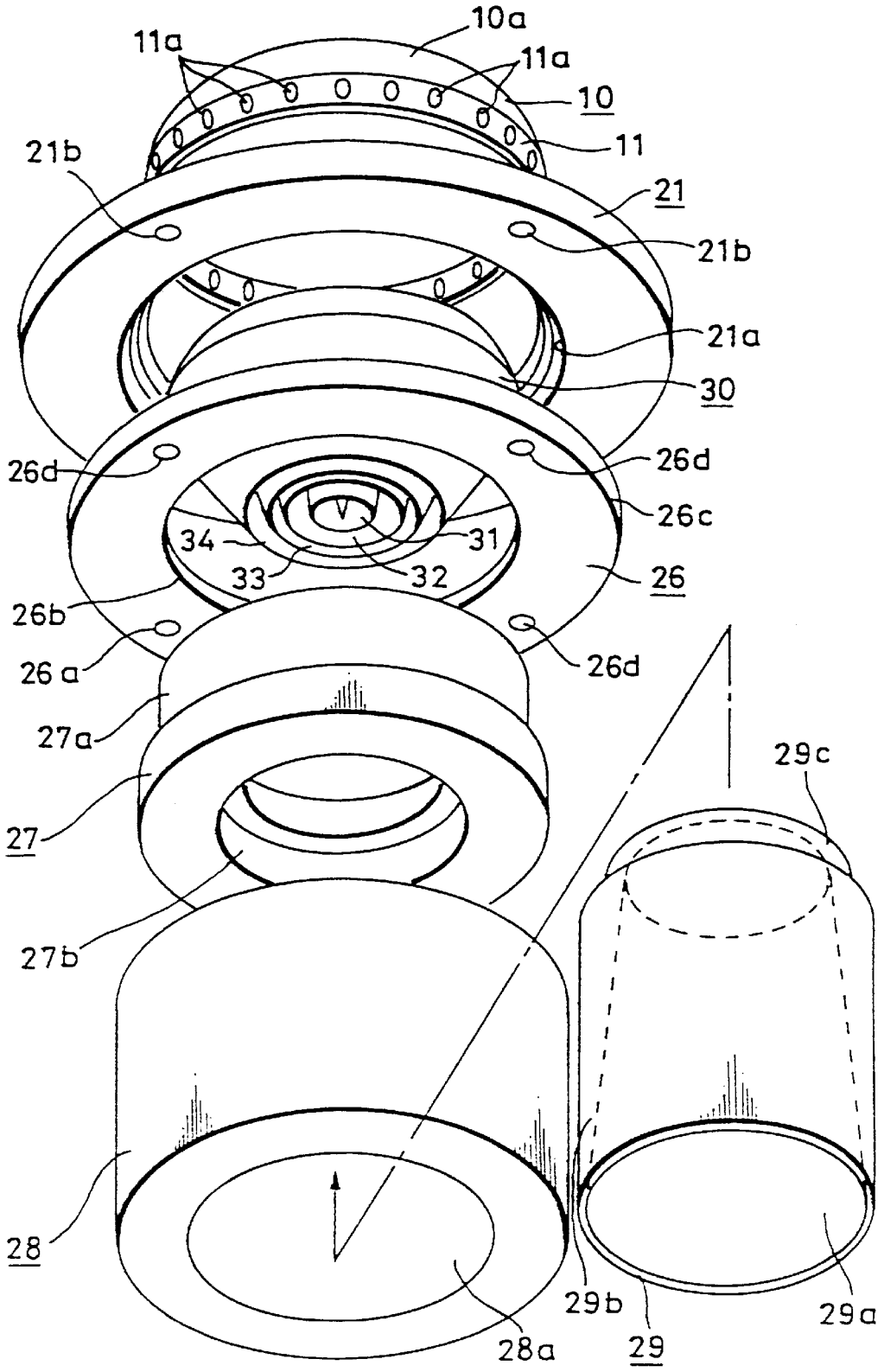
FIG. 2 is an exploded perspective view of the horn speaker system.

As shown in FIG. 1, the horn speaker system has a dome-shaped diaphragm 10 integral with a tubular coil bobbin 11 disposed on an outer circumferential portion of a dome-shaped member. A voice coil 12 is wound on the coil bobbin 11. As shown in FIG. 2, the coil bobbin 11 has a plurality of circumferentially spaced slits 11*a* defined in a direction perpendicular to the direction in which the voice coil 12 is wound, i.e., in a direction in which the diaphragm 10 vibrates.

An annular edge 13 is joined to the outer circumferential portion of the diaphragm 10. The edge 13 is sandwiched between a plate 21 and an annular holder 24 disposed on an upper surface of the plate 21, so that the diaphragm 10 is supported by the plate 21. Spacers 22, 23 are disposed between the plate 21 and the holder 24 for adjusting the height of the diaphragm 10. The holder 24 is fastened to the plate 21 by downwardly threaded screws 25*a*, thus fixing the edge 13 to the speaker unit. A guide ring 26 is fixed to a lower surface of the plate 21 by screws 25*b* which are upwardly threaded toward the screws 25*a*. The guide ring 26 has a step 26*a* which is fitted with a step 21*a* of the plate 21. Therefore, the guide ring 26 is automatically positioned with respect to the plate 21 once the plate 21 is positioned.

The horn speaker system has a phase equalizer 30 disposed complementarily in shape to the dome-shaped diaphragm 10. The phase equalizer 30, which is formed as an aluminum die casting, serves to collect sounds produced upon vibration of the diaphragm 10 in phase with each other, and radiate the collected sounds. The phase equalizer 30 has four concentric annular slits 31, 32, 33, 34 for collecting the sounds from the diaphragm 10. The phase equalizer 30 will be described in detail later on.

A tubular pole piece 27 is attached to the phase equalizer 30 remotely from the diaphragm 10, i.e., to a lower side of the phase equalizer 30 as viewed in FIG. 1. The pole piece 27 has an outer circumferential surface 27*a* which is of the same diameter as the diameter of an inner circumferential surface 26*a* of the guide ring 26. The pole piece 27 is installed in place with the outer circumferential surface 27*a* and the inner circumferential surface 26*a* being held in contact with each other. Therefore, the pole piece 27 is automatically positioned with respect to the guide ring 26 once the guide ring 26 is positioned. The pole piece 27 has a central through hole 27*b* for connection of a throat 29 (described later on) to the pole piece 27. The pole piece 27, the plate 21, and other members jointly make up a magnetic circuit of the horn speaker system. Both the pole piece 27 and the plate 21 are made of a magnetic material.

The pole piece 27 has a recess 27*c* defined in a surface thereof which faces the phase equalizer 30, the recess 27*c* receiving a ridge 35 of the phase equalizer 30. With the ridge 35 fitted in the recess 27*c*, the phase equalizer 30 is placed over the pole piece 27 and slightly floats off the pole piece 27, defining a slit 36 between the pole piece 27 and the phase equalizer 30.

An annular or cylindrical magnet 28 is disposed on one side of the pole piece 27 remote from the phase equalizer 30, i.e., on a lower side of the pole piece 27 as viewed in FIG. 1. The magnet 28 has a central through hole 28*a* for connection of the throat 29 thereto. The central through hole 28*a* is slightly larger in diameter than the central through hole 27*b* in the pole piece 27.

The throat 29 which is of a tubular shape is disposed in the central through hole 28*a* in the magnet 28 and the central through hole 27*b* in the pole piece 27. The throat 29 serves to transmit sounds outputted from the phase equalizer 30 to a horn (not shown) connected to the throat 29, and has a through hole 29*a* for passing the sounds therethrough. The through hole 29*a* is progressively greater in diameter in a direction away from its end near the phase equalizer 30. The throat 29 has an outer circumferential surface 29*b* fitted in the central through hole 28*a* in the magnet 28. The outer circumferential surface 29*b* has an end 29*c* having a slightly smaller diameter which is fitted in the central through hole 27*b* in the pole piece 27. Therefore, the throat 29 is positioned with respect to the central through hole 27*b* in the pole piece 27, and the magnet 28 is positioned with respect to the throat 29. The throat 29 is made of copper in the illustrated embodiment.

The horn speaker system further includes a yoke 41 having a circular through hole 41*a*, and the outer circumferential surface 29*b* of the throat 29 is fitted in the circular through hole 41*a*. The yoke 41 is shaped to cover the outer circumferential surfaces of the guide ring 26, the pole piece 27, and the magnet 28. The yoke 41 has a plurality of threaded holes 41*b* defined therein for attachment of the non-illustrated horn. A back cover 42 is mounted on a surface of the plate 21 remote from the yoke 41, i.e., an upper surface of the plate 21 as viewed in FIG. 1. Specifically, the back cover 42 is fastened by screws or the like to the yoke 41 through the plate 21.

The pole piece 27 disposed within the voice coil 12 attached to the diaphragm 10, the magnet 28, the plate 21 disposed around the voice coil 12, and the yoke 41 which interconnects the magnet 28 and the plate 21 jointly make up the magnetic circuit of the horn speaker system. Specifically, the magnet 28, the pole piece 27, the phase equalizer 30, and the diaphragm 10 are stacked coaxially with each other. The magnetic circuit and the voice coil 12 coact with each other to produce magnetic forces to actuate the diaphragm 10. The diaphragm 10 is vibrated based on a drive signal supplied to the voice coil 12, enabling the horn speaker system to radiate sounds based on the drive signal.

The diaphragm 10, the plate 21, the phase equalizer 30, the guide ring 26, the pole piece 27, the magnet 28, and the throat 29 are shown in exploded perspective in FIG. 2. As shown in FIG. 2, the plate 21 and the guide ring 26 are fastened to each other by the screws 25*b* extending in screw holes 21*b*, 26*d* defined respectively therein. The pole piece 27 and the magnet 28 are magnetically attached to each other by the magnet 28. The yoke 41, which is omitted from illustration in FIG. 2, and the magnet 28 are also magnetically attached to each other by the magnet 28. In FIG. 2, no edge is shown as being attached to the diaphragm 10.

The magnetic circuit of the horn speaker system can be assembled by successively fitting the components of the magnetic circuit as shown in FIG. 2, and the components thus put together are positioned accurately with respect to each other. The groove, which serves as a gap of the horn speaker system, defined between the plate 21 and the pole piece 27 can accurately be defined without use of any gap gage or the like. Therefore, the horn speaker system with desired designed frequency characteristics can accurately and easily be assembled.

The pole piece 27 and the yoke 41 disposed around the magnet 28 are attracted to and remain combined with the magnet 28 under strong magnetic forces produced by the magnet 28. Therefore, it is not necessary to employ any adhesive to secure these components to the magnet in assembling the magnetic circuit. Since no adhesive which would block the flow of magnetic fluxes exists in the magnetic circuit, no eddy current is produced in the magnetic circuit, and the frequency characteristics of the horn speaker system are improved.

Figure 3:
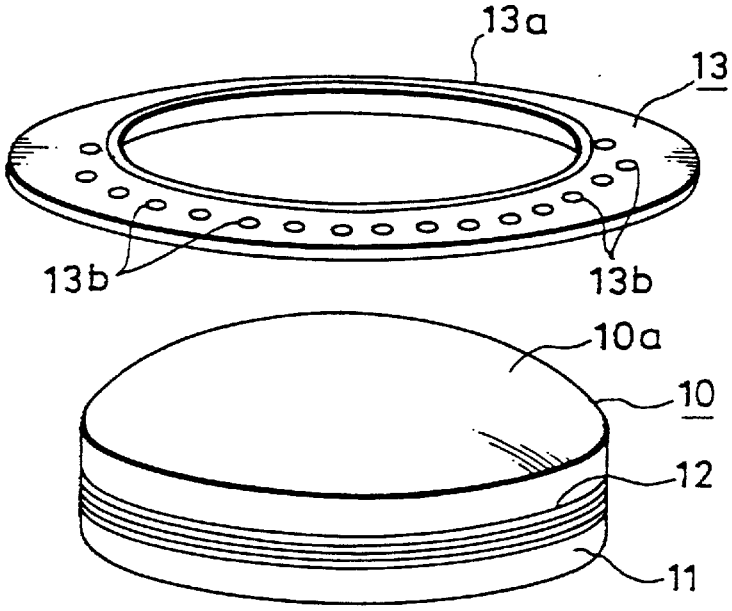
FIG. 3 is an exploded perspective view of a diaphragm and an edge of the horn speaker system.

The diaphragm 10 will be described in detail below. As shown in FIG. 3, the diaphragm 10 includes a dome 10*a* integrally formed with the coil bobbin 11 which is contiguous to the dome 10*a*. The dome 10*a* and the coil bobbin 11 are made of a sheet of titanium alloy which has a thickness of 20 $\mu$m. The voice coil 12 is bonded or otherwise secured to the coil bobbin 11 near and along its free edge.

Figure 4:
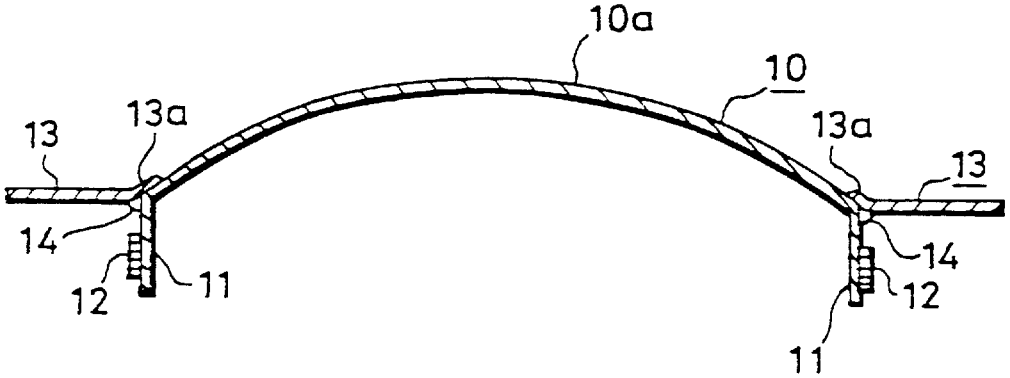
FIG. 4 is a cross-sectional view of the diaphragm.

The edge 13 has a central through hole 13*a* defined therein which has substantially the same diameter as the outside diameter of the dome 10*a*. As shown in FIG. 4, the peripheral edge of the central through hole 13*a* is bonded to the dome 10*a* by an adhesive 14. The edge 13 is made of a sheet of titanium alloy which has a thickness of 50 $\mu$m. Where the edge 13 is made of titanium alloy, the thickness of 50 $\mu$m is a minimum thickness to maintain a required degree of durability for the edge 13.

As shown in FIG. 3, the edge 13 has a plurality of circumferentially spaced stiffening ribs 13*b* positioned slightly radially outwardly from the through hole 13*a* for allowing the dome 10*a* to vibrate well.

The diaphragm 10 thus constructed is of a reduced weight while maintaining its durability required of a vibrating system. Specifically, when the diaphragm 10 vibrates, forces commensurate with the degree of vibration are applied to the edge 13. Since, however, the edge 13 is composed of a relatively thick sheet of titanium alloy which has a thickness of 50 $\mu$m, the material of the edge 13 is prevented from being broken due to metal fatigue. Nevertheless, the diaphragm 10 and the edge 13 are relatively light because the dome 10*a* and the coil bobbin 11 are made of a sheet of titanium alloy having a thickness of 20 $\mu$m. If the dome 10*a* has an outside diameter of 100 mm, for example, then the diaphragm 10, the edge 13, and the adhesive 14 may have a total weight of about 2.4 g.

If a dome and an edge were integrally formed to produce a comparative diaphragm of the same size, then in order to keep a required degree of edge durability, the dome and the edge would have to be made of a sheet of titanium alloy having a thickness of 50 $\mu$m, and would have a total weight of about 3.3 g.

Figure 5:
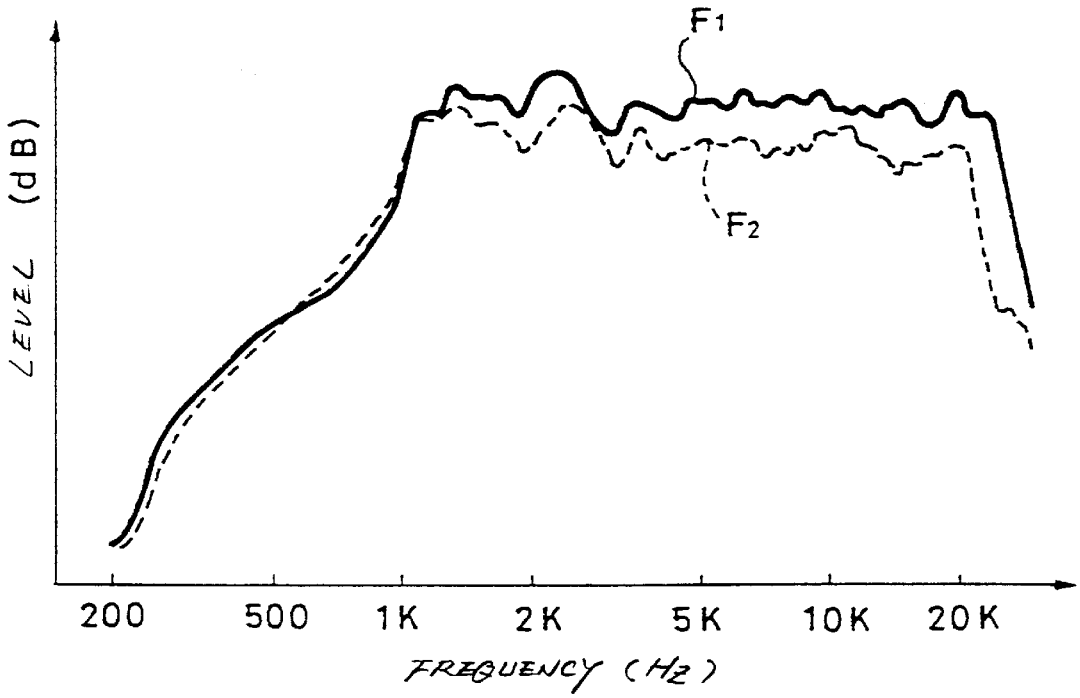
FIG. 5 is a diagram showing frequency characteristics of the horn speaker system with the diaphragm according to the embodiment and a horn speaker system with a comparative diaphragm.

Since the weight of the diaphragm 10 and the edge 13 according to the present invention is about 0.9 g lighter than the comparative diaphragm combined with the edge, the frequency characteristics of the horn speaker system are improved accordingly. FIG. 5 shows frequency characteristics $F_1$ of the horn speaker system which employs the diaphragm 10 and frequency characteristics $F_2$ of a horn speaker system which employs the comparative diaphragm referred to above. A study of the graph shown in FIG. 5 indicates that the level of sounds reproduced by the diaphragm 10 is higher than the level of sounds reproduced by the comparative diaphragm in an almost entire frequency range, and the level-frequency curve of the diaphragm 10 is flat up to about 25 kHz, but level-frequency curve of the comparative diaphragm is flat up to only about 20 kHz. As a result, the horn speaker system with the diaphragm 10 has its frequency range extended up to about 25 kHz.

In the above embodiment, both the dome 10*a* and the edge 13 are made of a titanium alloy. However, they may be made of an alloy of other metal such as aluminum or a combination of different alloys. For example, the dome 10*a* and the coil bobbin 10 may be made of a sheet of aluminum alloy having a thickness of 35 $\mu$m, whereas the edge 13 may be made of a sheet of titanium alloy having a thickness of 50 $\mu$m. According to such a modification, the diaphragm 10 and the edge 13 may have a weight of about 2.3 g if the dome 10*a* has an outside diameter of 100 mm.

The thicknesses indicated above are illustrative only, and may be of other values. Preferably, the thickness of the dome 10*a* and the coil bobbin 11 should be of 70% or less of the thickness of the edge 13 or 70% or less of a thickness equivalent in mechanical strength to the thickness of the material of the edge 13, for improved frequency characteristics. In an embodiment, the dome-shaped diaphragm is made of a material having a thickness which is at most 70% of a thickness equivalent in mechanical strength to a thickness of a material of said edge.

Furthermore, inasmuch as the slits 11*a* are defined at given intervals in the coil bobbin 11 integral with the diaphragm 10, the diaphragm 10 is allowed to vibrate well to give the horn speak system good frequency characteristics. More specifically, when the voice coil 12 is vibrated by the diaphragm 10, the slits 11*a* defined at given intervals in the coil bobbin 11 serve to prevent an eddy current from being developed in the metal coil bobbin 11. The slits 11*a* are also effective to reduce the mechanical Q of the dome 10*a*. Consequently, the horn speaker system has good frequency characteristics which are not affected by eddy currents and has less peaks at high frequencies.

Figure 6:
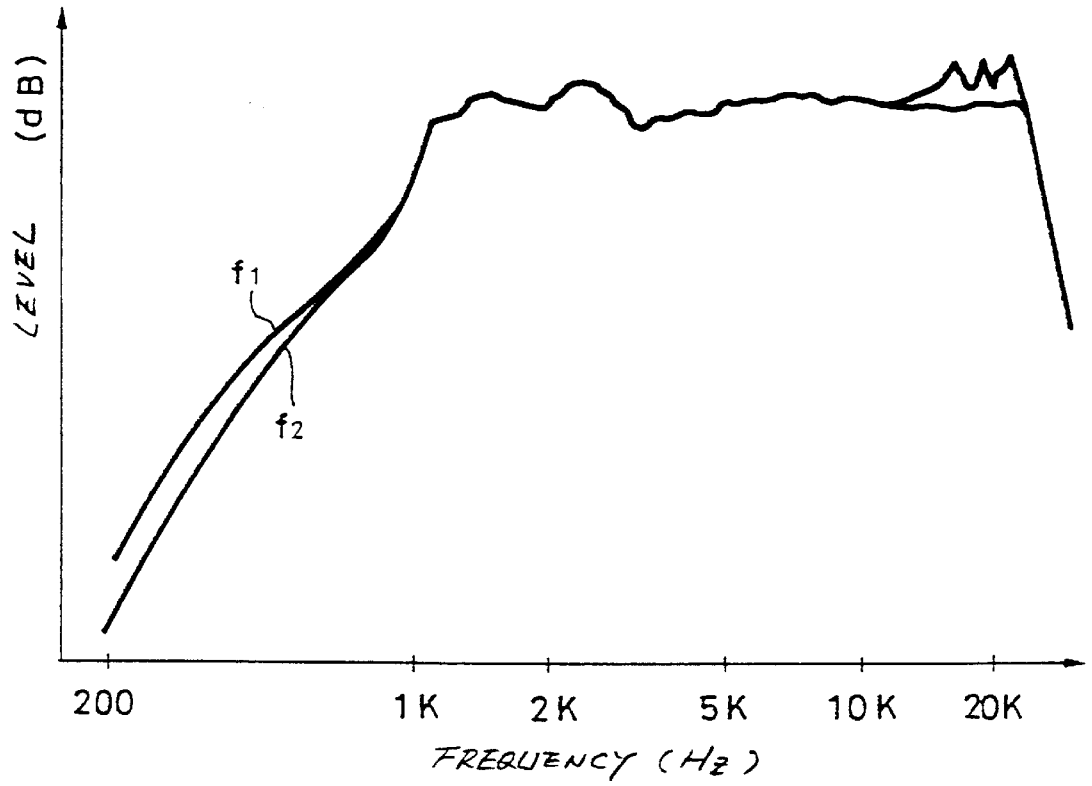
FIG. 6 is a diagram showing frequency characteristics of the horn speaker system with the slit diaphragm according to the embodiment and a horn speaker system with comparative diaphragm which is not slit.

FIG. 6 shows frequency characteristics $f_1$ of the horn speaker system which employs the diaphragm 10 with the slits 11*a* defined in the coil bobbin 11 and frequency characteristics $f_2$ of a horn speaker system which employs a diaphragm with no slits defined in its coil bobbin. A review of the graph shown in FIG. 6 shows that the level of the frequency characteristics $f_1$ of the horn speaker system with the slit diaphragm 10 is higher than the level of the frequency characteristics $f_2$ of the horn speaker system with the non-slit diaphragm in a low frequency range lower than 1 kHz, and the response-frequency curve of the horn speaker system with the slit diaphragm 10 is flatter than the response-frequency curve of the horn speaker system with the non-slit diaphragm in a high frequency range higher than 10 kHz.

Figure 7:
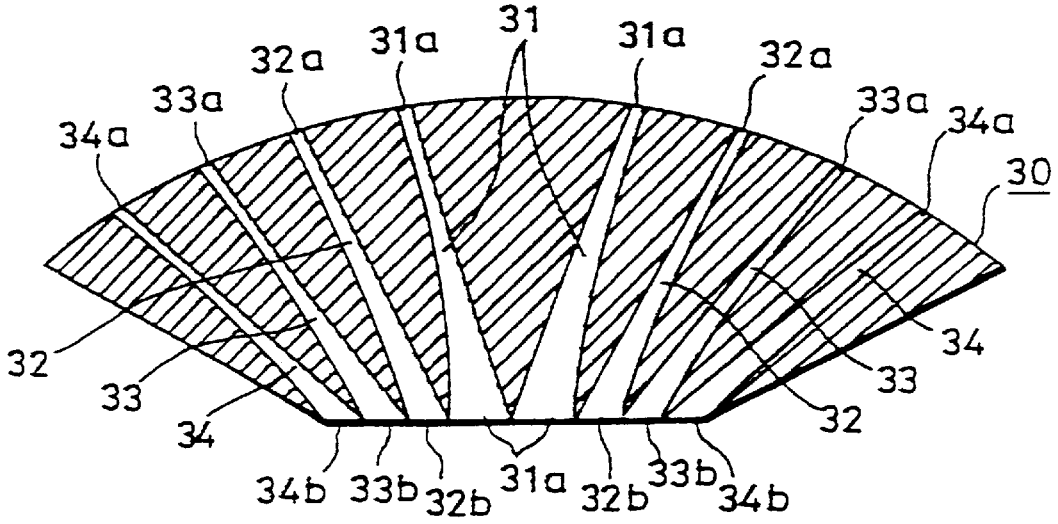
FIG. 7 is a cross-sectional view of a phase equalizer of the horn speaker system.
Figure 8:
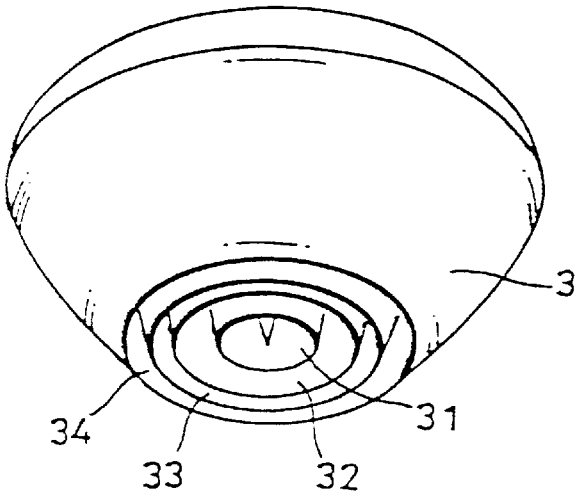
FIG. 8 is a perspective view of the phase equalizer.

The phase equalizer 30 will be described in detail below with reference to FIGS. 7 through 10. The phase equalizer 30 is positioned closely against the dome-shaped diaphragm 10. As shown in FIG. 7, the phase equalizer 30 has a partly spherical surface held closely against and shaped complementarily to the dome-shaped diaphragm 10. As shown in FIGS. 7 and 8, the phase equalizer 30 is of a conical shape with the partly spherical surface at its bottom.

Figure 9:
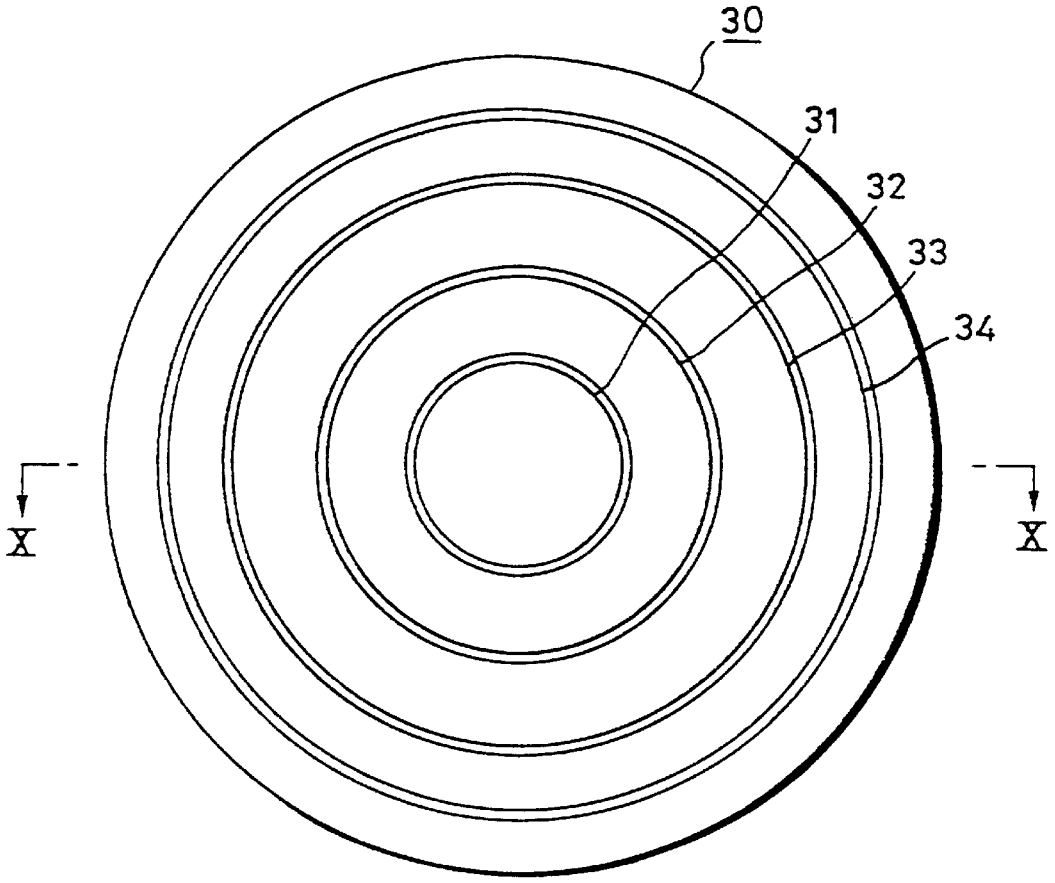
FIG. 9 is a plan view of the phase equalizer.

The slits 31, 32, 33, 34 are defined concentrically in the partly spherical surface which is held closely against the dome-shaped diaphragm 10. As shown in FIG. 9, the slits 31, 32, 33, 34 are positioned successively radially outwardly from the center in the order named. The slits 31, 32, 33, 34 extend through the phase equalizer 30 to a surface thereof remote from the partly spherical surface. In the surface of the phase equalizer 30 remote from the partly spherical surface thereof, the slits 31, 32, 33, 34 are positioned concentrically in a successive pattern.

The slits 31, 32, 33, 34 have respective cross-sectional areas across a partly spherical surface concentric with the partly spherical surface held closely against the dome-shaped diaphragm 10. The cross-sectional areas of the respective slits 31, 32, 33, 34 progressively increase linearly in a direction away from the diaphragm 10. Specifically, the cross-sectional areas of the respective slits 31, 32, 33, 34 progressively increase linearly as they move from respective inlets 31*a*, 32*a*, 33*a*, 34*a* thereof (see FIG. 7) close to the diaphragm 10 toward respective inlets 31*a*, 32*a*, 33*a*, 34*a* thereof (see FIG. 7) remote from the diaphragm 10. These cross-sectional areas are expressed by the following equation (1):

$$S=S_0\times ex(ax) \quad (1)$$

where S is a cross-sectional area across a partly spherical surface, $S_0$ is a cross-sectional area at the inlets 31*a*, 32*a*, 33*a*, 34*a*, "a" is a constant value for determining the rate of increase of the cross-sectional area, and "x" the distance from the inlets. In this embodiment, the value "a" for determining the rate of increase of the cross-sectional area is the same for the slits 31, 32, 33, 34.

Figure 11:
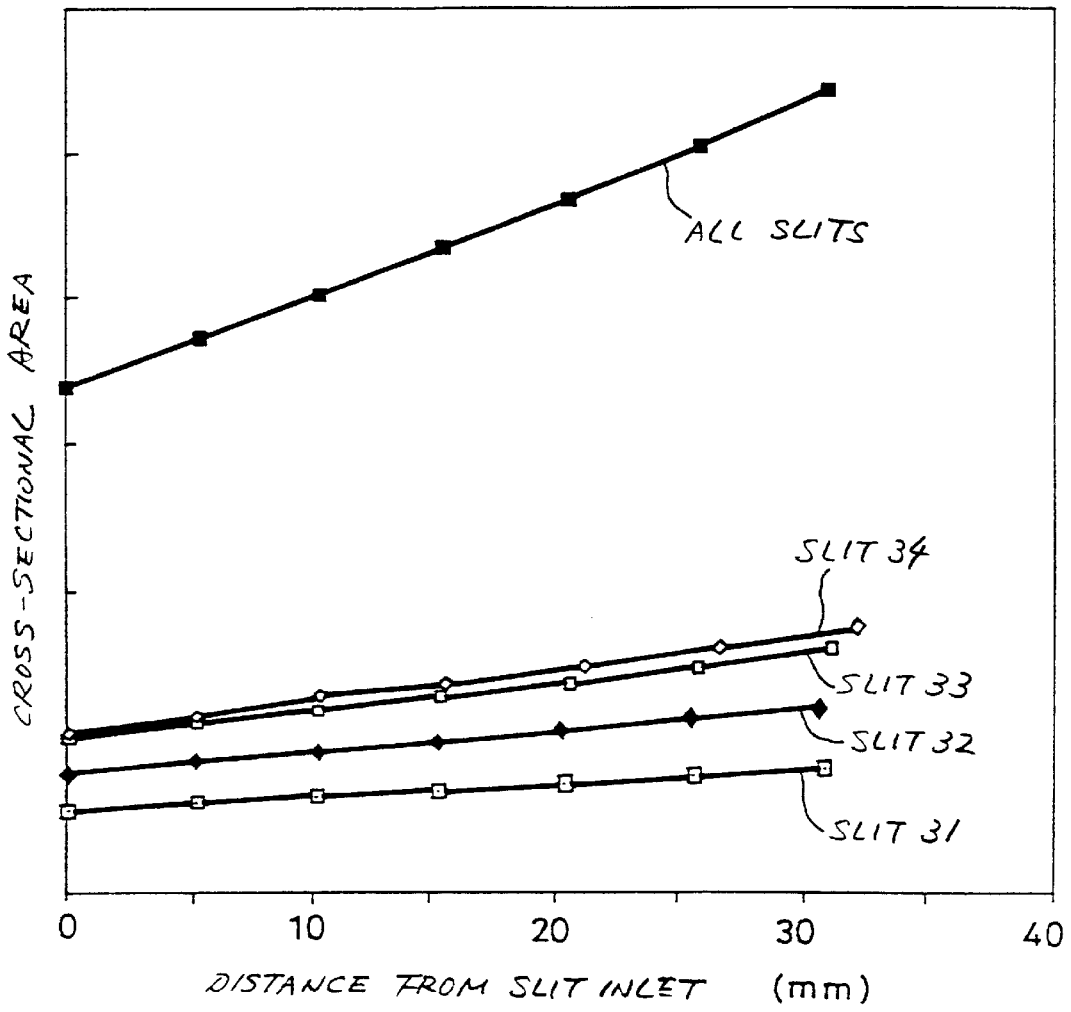
FIG. 11 is a diagram showing the cross-sectional areas of slits in the phase equalizer as they vary depending on the distance from the inlet ends of the slits.

The cross-sectional areas of the respective slits 31, 32, 33, 34 as they vary depending on the distance from the inlets 31*a*, 32*a*, 33*a*, 34*a* are shown in FIG. 11. As shown in FIG. 11, the cross-sectional areas of the respective slits 31, 32, 33, 34 are progressively greater in the order named. The rate of increase of the cross-sectional area remains substantially constant for all the slits 31, 32, 33, 34, and their cross-sectional areas increase linearly. Therefore, the sum of the cross-sectional areas of all the slits 31, 32, 33, 34 also increases linearly.

Figures 12A, 12B, 12C, 12D:
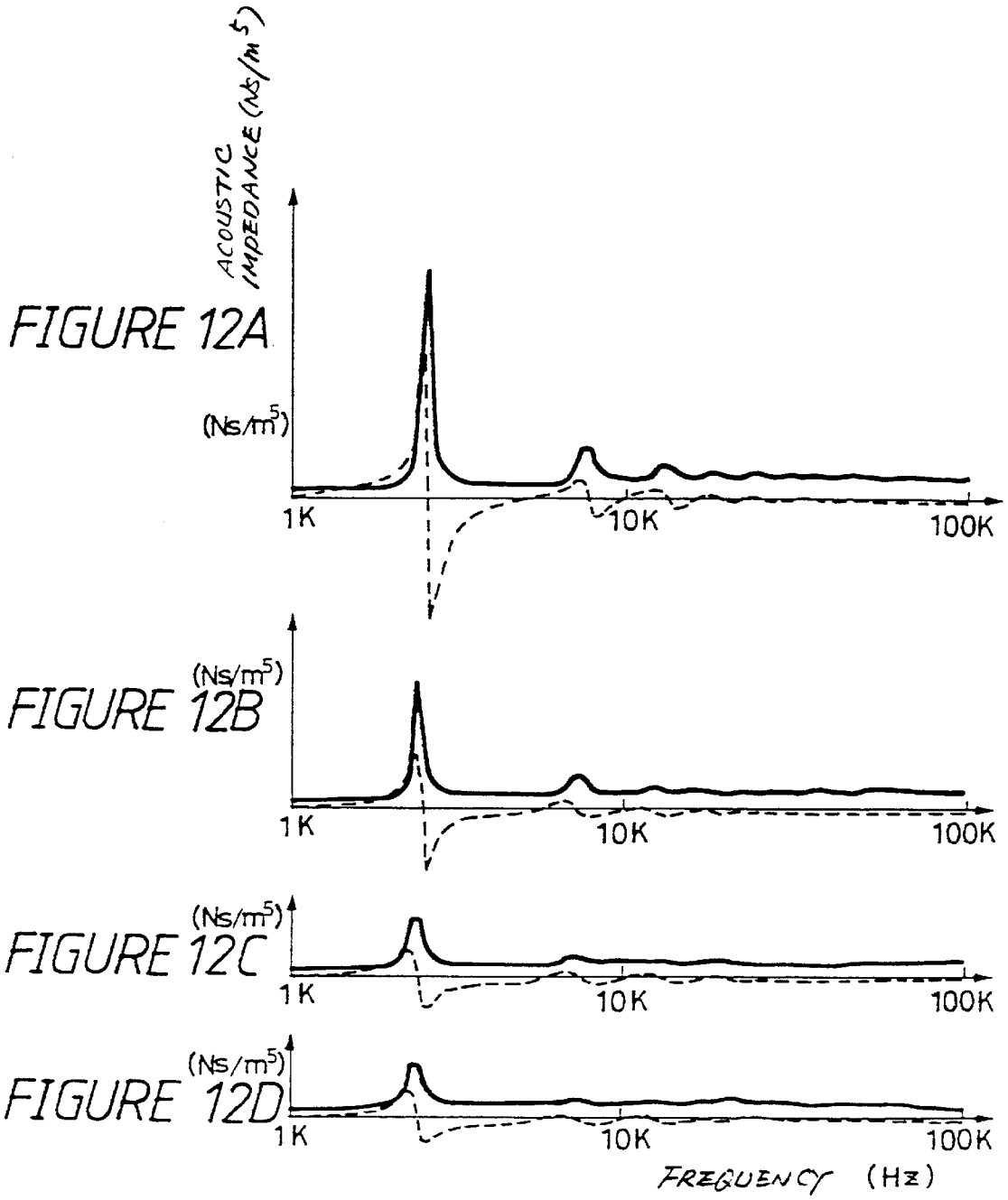
FIGS. 12A through 12D are diagrams showing the frequency characteristics of acoustic impedances of the slits of the phase equalizer.

The slits 31, 32, 33, 34 of the phase equalizer 30 have respective acoustic impedances which are free from resonance. More specifically, FIGS. 12A, 12B, 12C, 12D illustrate the acoustic impedances, respectively, of the slits 31, 32, 33, 34. In each of FIGS. 12A, 12B, 12C, 12D, the solid-line curve represents an acoustic resistance, and the broken-line curve represents an acoustic reactance. As shown in FIG. 12A, the acoustic impedance of even the innermost slit 31 is relatively low.

Figure 13:
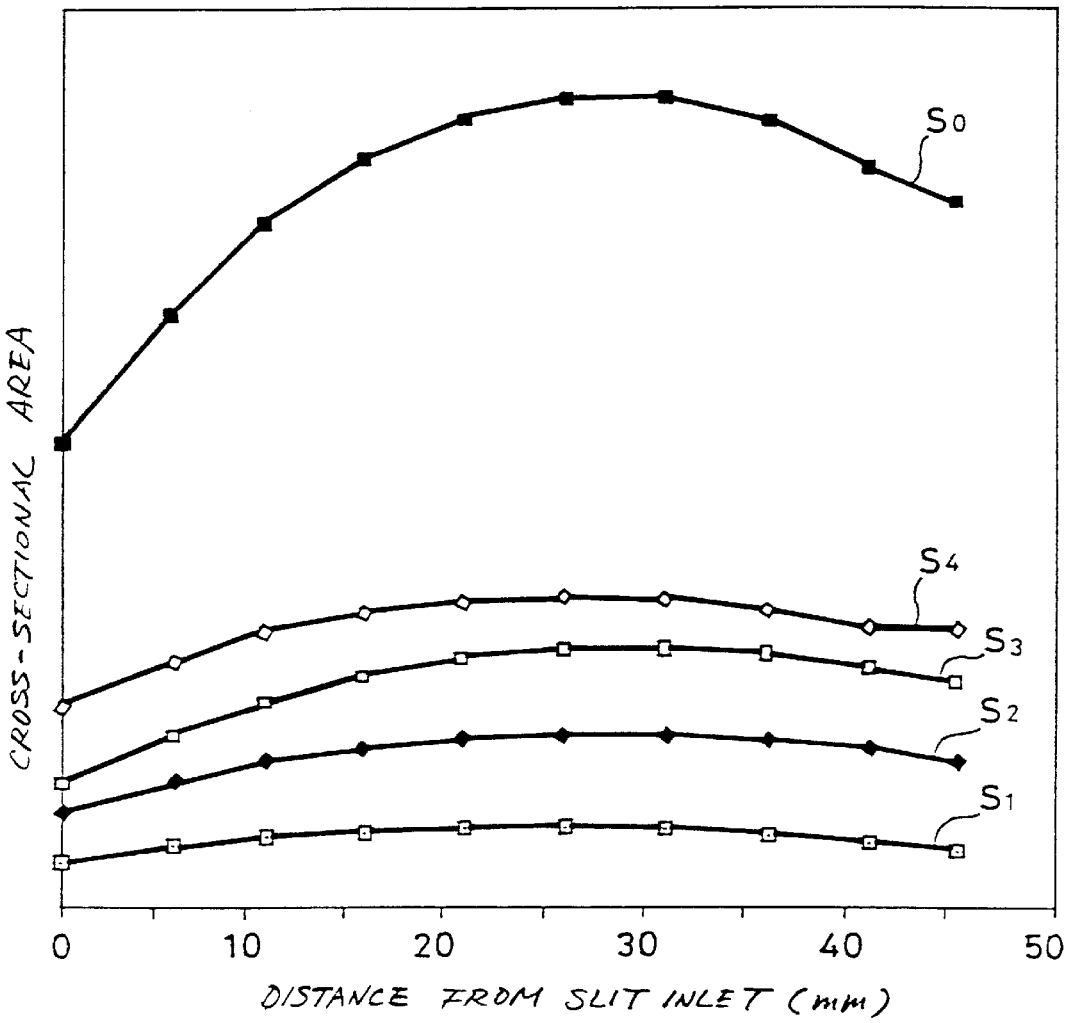
FIG. 13 is a diagram showing the cross-sectional areas of slits in a comparative phase equalizer as they vary depending on the distance from the inlet ends of the slits.
Figures 14A, 14B, 14C, 14D:
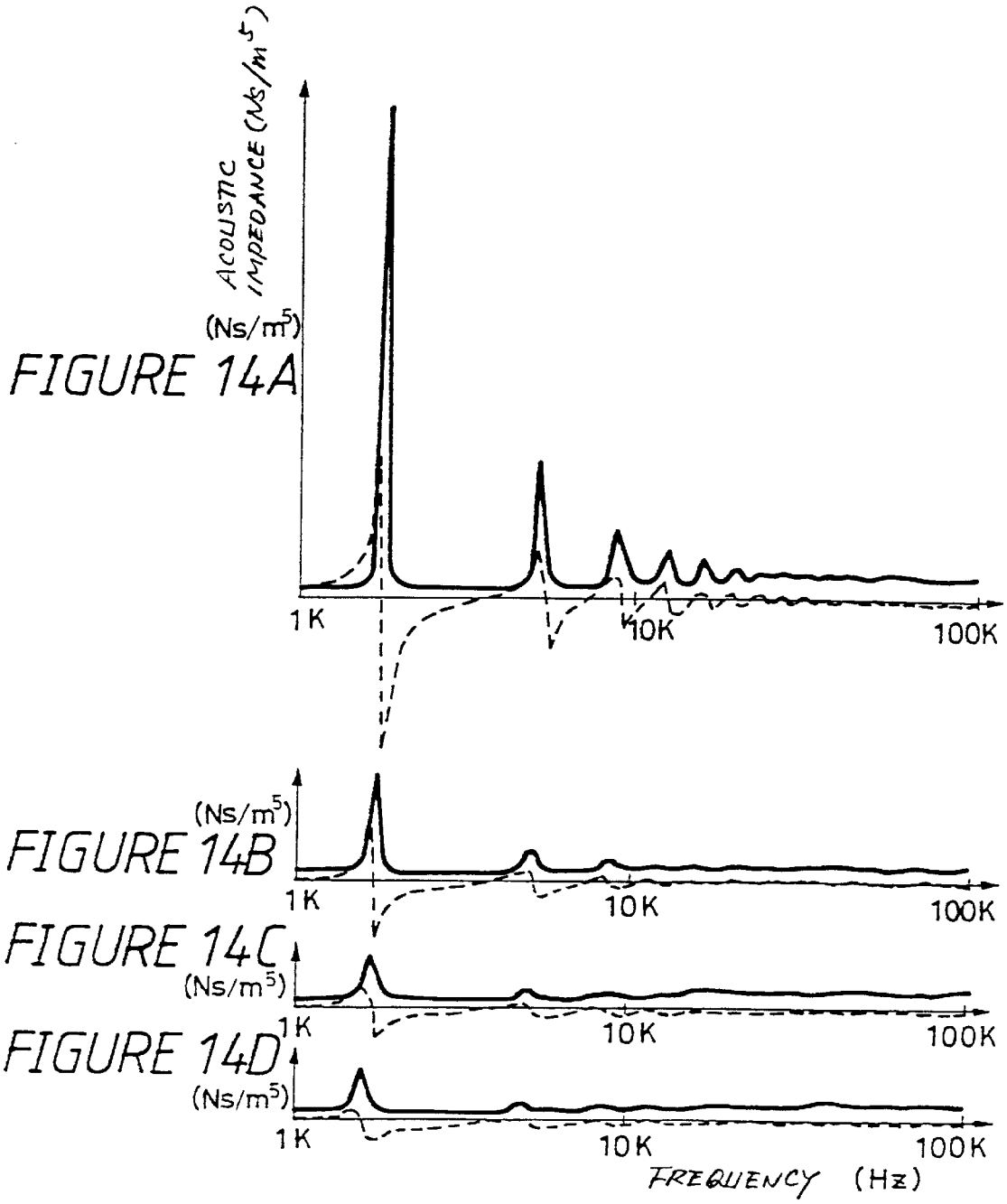
FIGS. 14A through 14D are diagrams showing the frequency characteristics of acoustic impedances of the slits of the comparative phase equalizer.

A comparative phase equalizer will be discussed below. As shown in FIG. 13, the comparative phase equalizer has a plurality of successive concentric slits $S_1$, $S_2$, $S_3$, $S_4$ (the slits $S_1$ being the innermost) which have respective cross-sectional areas across a partly spherical surface. The cross-sectional areas of the respective slits $S_1$, $S_2$, $S_3$, $S_4$ vary in a curved pattern, and decrease in the vicinity of outlets thereof. The sum of the cross-sectional areas of the slits $S_1$, $S_2$, $S_3$, $S_4$ is indicated by $S_0$ in FIG. 13. The slits $S_1$, $S_2$, $S_3$, $S_4$ of the comparative phase equalizer have respective acoustic impedances as shown in FIGS. 14A, 14B, 14C, 14D. In each of FIGS. 14A, 14B, 14C, 14D, the solid-line curve represents an acoustic resistance, and the broken-line curve represents an acoustic reactance. As shown in FIG. 14A, the acoustic impedance of the innermost slit $S_i$ exhibits sharp resonance.

Figure 10:
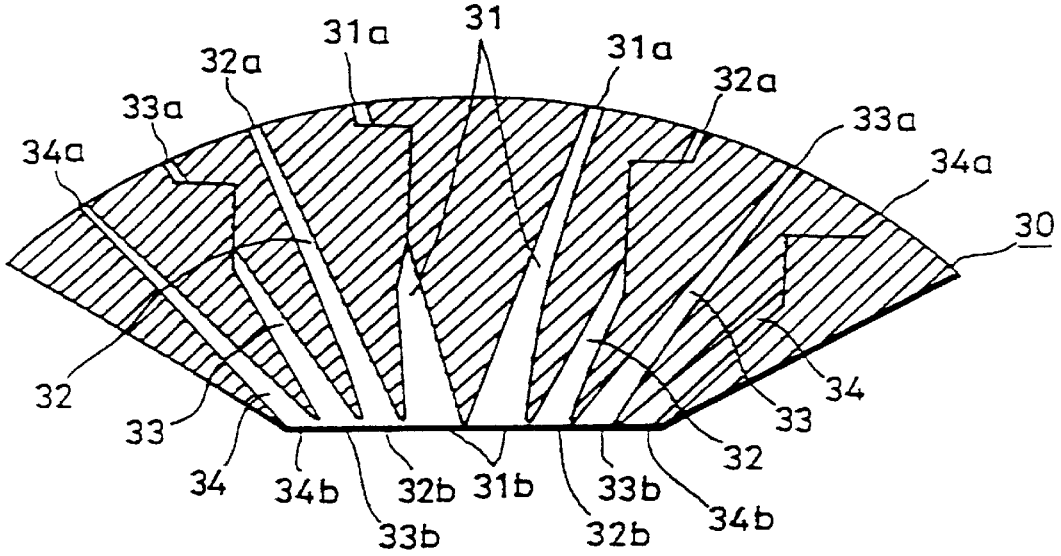
FIG. 10 is cross-sectional view taken along line X—X of FIG. 9.

As shown in FIG. 10, the slits 31, 32, 33, 34 in the phase equalizer 30 are partly closed, so that the phase equalizer 30 is made of interconnected members to guard against separation due to the slits 31, 32, 33, 34.

The phase equalizer 30 in the horn speaker system is effective in reducing resonance of acoustic impedances to a level lower than the conventional phase equalizer, and does not make the reproduced sounds indistinct for thereby allowing the horn speaker system to reproduce clear sounds with good characteristics.

Since the shapes of the slits 31, 32, 33, 34 may be determined according to the above equation (1), the phase equalizer 30 can be designed and manufactured based on the simple equation for good characteristics.

In the illustrated embodiment, as shown in FIG. 1, the slit 36 is defined between the phase equalizer 30 and the pole piece 27. The slit 36 has a constant width and has its cross-sectional area not increasing linearly for good reproduction characteristics. More specifically, the outermost slit 36 picks up resonant sounds produced when the coil bobbin 11 of the diaphragm 10 is vibrated. Since the width of the slit 36 is constant, the resonant sounds thus produced are not transmitted through the slit 36. Accordingly, the horn speaker system has good characteristics against resonant sounds.

In the above embodiment, the cross-sectional areas of the slits 31, 32, 33, 34 increase linearly and the constant value "a" for determining the rate of increase of the cross-sectional areas of the slits 31, 32, 33, 34 is the same for the slits 31, 32, 33, 34. However, the cross-sectional areas of the slits 31, 32, 33, 34 may increase in a pattern rather than the linear pattern, and the rates of increase of the cross-sectional areas of the slits 31, 32, 33, 34 may differ from each other. That is, the cross-sectional areas may be expressed by the following equation (2):

$$S=S_0\times ex(aix) \tag{2}$$

where "ai" is a rate of increase of the cross-sectional area which is different between the slits. According to this equation, the cross-sectional area of each slit increases exponentially.

Alternatively, the cross-sectional areas may be expressed by the following equation (3):

$$S=f(x),\ f'(x)>0 \tag{3}$$

The equation (3) indicates that the cross-sectional area S progressively increases as a function of the distance "x" along the slit. The rate of increase of the cross-sectional area may not be defined as indicated by the equation (3).

The dome-shaped metal diaphragm 10 is heated when it vibrates. The heat produced by the vibrating diaphragm 10 is transferred to the phase equalizer 30 which is in the form of an aluminum die casting having a relatively high thermal conductivity. The throat 29 for guiding sounds outputted from the phase equalizer 30 is made of copper which also has a relatively high thermal conductivity. Therefore, the heat transferred to the phase equalizer 30 is transferred to the throat 29 and then the horn. The heat is radiated together with the reproduced sounds into the exterior space. Thus, the heat generated by the diaphragm 10 is efficiently dissipated from the horn speaker system. The horn speaker system is effectively prevented from being damaged or broken due to the heat produced by the diaphragm 10.

While the phase equalizer 30 comprises an aluminum die casting and the throat 29 is made of copper in the illustrated embodiment, they may be made of other different metals each having a relatively high thermal conductivity.

According to the above embodiment, the horn speaker system is assembled successively from the plate 21. However, the horn speaker system may be assembled by fitting the throat 29 in the yoke 41, fitting the magnet 28 over the throat 29, and installing the pole piece 27 and the phase equalizer 30 on the magnet 28.

The dome 10*a*, the coil bobbin 11, and the edge 13 may be made of any of various other materials other than a titanium alloy or an aluminum alloy. For example, the edge 13 may be made of a highly resilient material such as highly resilient biocellulose produced by culturing a bacterium, or carbon fibers. In the case where the edge 13 is made of highly resilient biocellulose or carbon fibers, the diaphragm 10 combined with the edge 13 may be further reduced in weight for better characteristics. For further details of bacterial cellulose, reference should be made to U.S. Pat. No. 4,742,164, for example. Thus, the edge may be made of a material selected from the group consisting of titanium, bacterial cellulose produced by culturing a bacterium and carbon fibers.

In the illustrated embodiment, the slit 36 defined between the phase equalizer 30 and the pole piece 27 is of a constant width. However, the outermost slit 34 defined in the phase equalizer 30 may be of a constant width, or the slit 36 may be of a cross-sectional area which varies according to the equation (1), for example.

In the illustrated embodiment, both the phase equalizer 30 and the throat 29 are made of metals each having a relatively high thermal conductivity. However, only the phase equalizer 30 which is positioned closely to the diaphragm 10 may be made of a metal having a relatively high thermal conductivity. Such a modification is also effective in radiating produced heat.

Having described preferred embodiments of the invention with reference to the accompanying drawings, it is to be understood that the invention is not limited to those precise embodiments and that various changes and modifications could be effected by one skilled in the art without departing from the spirit or scope of the invention as defined in the appended claims.

What is claimed is:

1. A horn speaker system comprising:

a dome-shaped diaphragm integrally-formed at a peripheral edge with a tubular coil bobbin wherein said diaphragm and said coil bobbin have a substantially uniform first thickness and said coil bobbin includes a plurality of circumferentially-spaced bobbin slits defined in a direction in which said diaphragm vibrates;

a substantially planer, annularly-shaped edge member having a substantially uniform second thickness, said edge member having a central through-hole defining an inner circumferential edge and having a plurality of circumferentially-spaced stiffening ribs extending substantially radially outwardly from said inner circumferential edge, said edge member separately attached to said dome-shaped diaphragm wherein said inner circumferential edge of said edge member is fixedly engaged with said peripheral edge of said diaphragm, and wherein said first thickness of said dome-shaped diaphragm and said coil bobbin is at most 70% of a thickness equivalent in mechanical strength to said second thickness of said edge member;

a voice coil wound around said coil bobbin;

a magnetic circuit coacting with said voice coil for producing forces to actuate said dome-shaped diaphragm;

a phase equalizer for keeping sounds outputted from said dome-shaped diaphragm in phase, said phase equalizer being mounted on said magnetic circuit, said phase equalizer having a partly spherical surface facing said dome-shaped diaphragm and having a plurality of concentric equalizer slits defined therethrough and extending from said partly spherical surface toward a surface thereof opposite to said partly spherical surface, at least one of said equalizer slits having a cross-sectional area across a partly spherical surface concentric with said partly spherical surface facing said dome-shaped diaphragm, said cross-sectional area progressively increasing in a direction from said partly spherical surface facing said dome-shaped diaphragm toward said surface opposite to said partly spherical surface, and wherein said equalizer slits include an outermost equalizer slit having a cross-sectional area which is constant in said direction from said partly spherical surface facing said dome-shaped diaphragm toward said surface opposite to said partly spherical surface; and a tubular throat disposed proximate to said surface of said phase equalizer opposite to said partly spherical surface thereof, said throat having an inside diameter progressively greater in a direction in which sounds outputted from said phase equalizer are radiated, said throat having an end mounted on said magnetic circuit in communication with said equalizer slits of said phase equalizer.

2. A horn speaker system according to claim 1, wherein said throat is made of a material having a relatively high thermal conductivity.

3. A horn speaker system according to claim 1, wherein said phase equalizer is made of a material having a relatively high thermal conductivity.

4. A horn speaker system according to claim 1, wherein said phase equalizer is mounted on said magnetic circuit at said surface opposite to the partly spherical surface, said magnetic circuit having an opening communicating with said slits, and wherein said magnetic circuit, said phase equalizer, and said dome-shaped diaphragm are stacked coaxially with each other.

* * * * *